US010773871B2

(12) United States Patent
Schütz

(10) Patent No.: US 10,773,871 B2
(45) Date of Patent: Sep. 15, 2020

(54) INNER CONTAINER MADE OF PLASTIC AND TRANSPORT AND STORAGE CONTAINER FOR LIQUIDS COMPRISING SUCH AN INNER CONTAINER

(71) Applicant: PROTECHNA S.A., Fribourg (CH)

(72) Inventor: Udo Schütz, Selters (DE)

(73) Assignee: PROTECHNA S.A., Fribourg (CH)

( * ) Notice: Subject to any disclaimer, the term of this patent is extended or adjusted under 35 U.S.C. 154(b) by 118 days.

(21) Appl. No.: 14/898,962

(22) PCT Filed: Jul. 3, 2014

(86) PCT No.: PCT/EP2014/064235
§ 371 (c)(1),
(2) Date: Dec. 16, 2015

(87) PCT Pub. No.: WO2015/001042
PCT Pub. Date: Jan. 8, 2015

(65) Prior Publication Data

US 2016/0368684 A1 Dec. 22, 2016

(30) Foreign Application Priority Data

Jul. 4, 2013 (DE) ..... 10 2013 213 167

(51) Int. Cl.
*B65D 77/04* (2006.01)
*B01F 7/00* (2006.01)
(Continued)

(52) U.S. Cl.
CPC ..... *B65D 77/0466* (2013.01); *B01F 7/0025* (2013.01); *B01F 7/00458* (2013.01);
(Continued)

(58) Field of Classification Search
CPC . B65D 77/0466; B01F 7/0025; B01F 7/00458
(Continued)

(56) References Cited

U.S. PATENT DOCUMENTS 3,830,406 A * 8/1974 Robb ..... F25D 23/12 222/108
4,932,551 A 6/1990 Thomas et al.
(Continued)

FOREIGN PATENT DOCUMENTS

CN 1041919 A 5/1990
CN 1066036 11/1992
(Continued)

OTHER PUBLICATIONS

Machine Translation of DE 102007044279 Al from WIPO.int.*

*Primary Examiner* — Jeremy Carroll
(74) *Attorney, Agent, or Firm* — McGlew and Tuttle, P.C.

(57) ABSTRACT

An inner plastic liquid container (25) includes a filling neck (41) in an upper wall (33) for filling the inner container and a front side outlet neck (40) for an outlet armature. A lower wall (28) interconnecting two side walls (30, 31), a rear wall (32) and a front wall (29) supports the container on a transport pallet (21) pallet base (26), which has an outer mantle (24) for receiving the container. The outlet neck is at a hopper bottom (39) of an outlet hopper (34) in the lower bottom wall. The outlet hopper has a front hopper wall (35) and inclined lateral hopper walls (36, 37) that are arranged at a hopper angle and each extend from a keel-shaped hopper base (38) to a lower edge (46, 47) of a side wall. A keel line (63) rises at another hopper angle from an outlet neck toward the rear wall.

24 Claims, 5 Drawing Sheets

(51) Int. Cl.
*B65D 1/20* (2006.01)
*B65D 88/28* (2006.01)
*B65D 90/12* (2006.01)
*B01F 3/00* (2006.01)

(52) U.S. Cl.
CPC ..... *B01F 7/00733* (2013.01); *B65D 1/20* (2013.01); *B65D 88/28* (2013.01); *B65D 90/12* (2013.01); *B01F 2003/0028* (2013.01)

(58) Field of Classification Search
USPC ..... 222/185.1, 183
See application file for complete search history.

(56) References Cited

U.S. PATENT DOCUMENTS 5,024,346 A * 6/1991 Roser ..... B65D 77/0453 220/485
5,253,777 A 10/1993 Schutz
5,316,174 A * 5/1994 Schutz ..... B29C 70/345 206/386
5,845,799 A * 12/1998 Deaton ..... B65D 19/18 220/1.5
6,827,237 B2 * 12/2004 Yorn ..... B65D 77/062 222/105
7,107,912 B2 * 9/2006 Schutz ..... B65D 19/10 108/55.1
2004/0107879 A1 * 6/2004 Schutz ..... B65D 77/0466 108/51.11
2009/0212048 A1 * 8/2009 Schutz ..... B65D 77/0466 220/4.12
2009/0223848 A1 9/2009 Schutz
2010/0055380 A1 * 3/2010 Schutz ..... B65D 25/205 428/81
2011/0249526 A1 10/2011 Wong
2011/0297702 A1 12/2011 Hildebrandt et al.
2013/0068795 A1 * 3/2013 Kim ..... B67D 3/0025 222/226

FOREIGN PATENT DOCUMENTS

CN 101508378 A 8/2009
CN 102892487 A 1/2013
DE 91 07 212 U1 8/1991
DE 41 08 399 C1 10/1992
DE 102 15 023 A1 10/2003
DE 10 2007 044279 A1 4/2009
DE 20 2012 000289 U1 3/2012
EP 2 090 520 A1 8/2009
EP 2248730 A1 11/2010
FR 2 966 810 A1 5/2012
KR 200 447 769 Y1 2/2010

* cited by examiner

Fig. 1
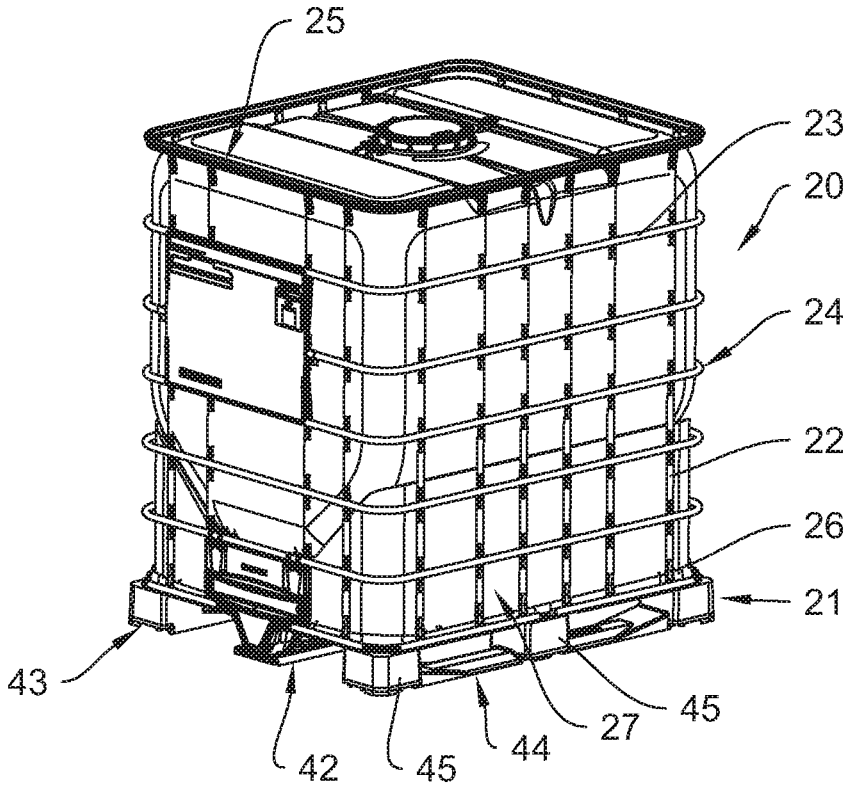
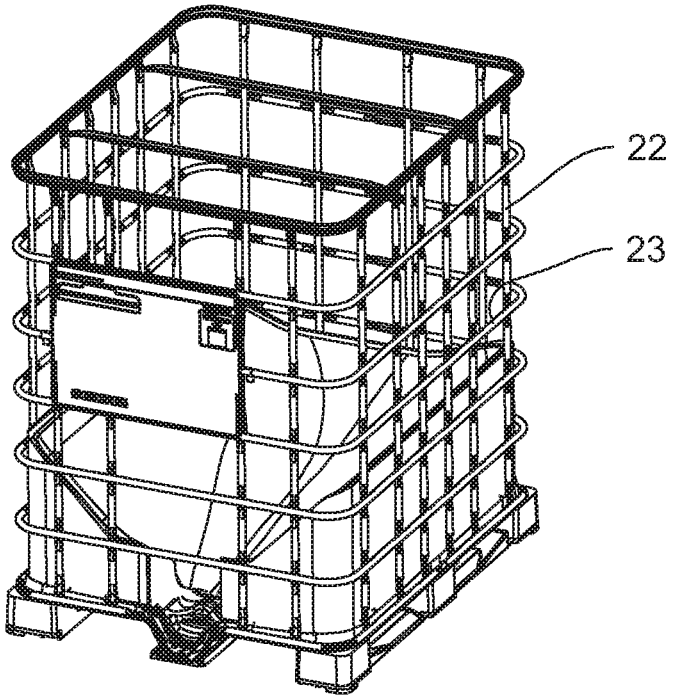
Fig. 2

Fig. 6
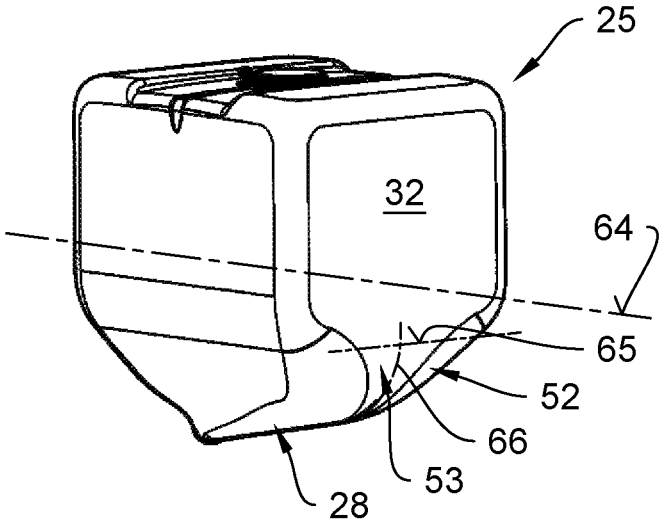
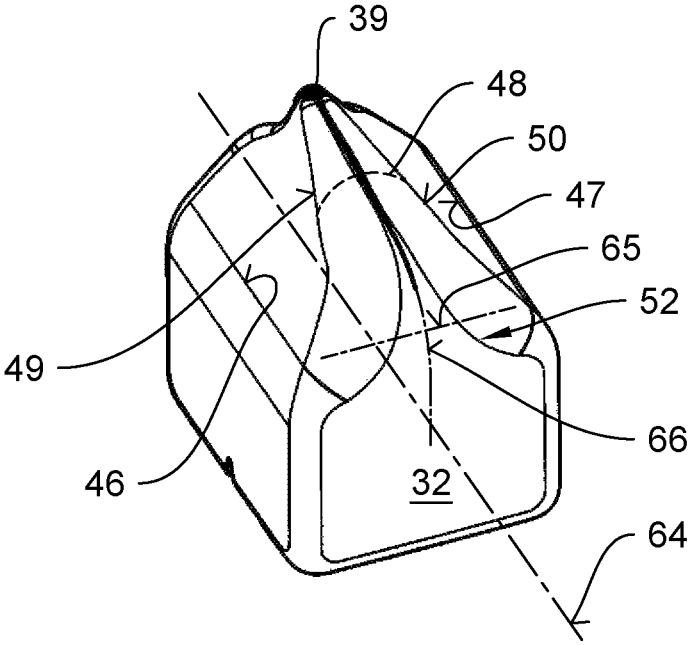
Fig. 7

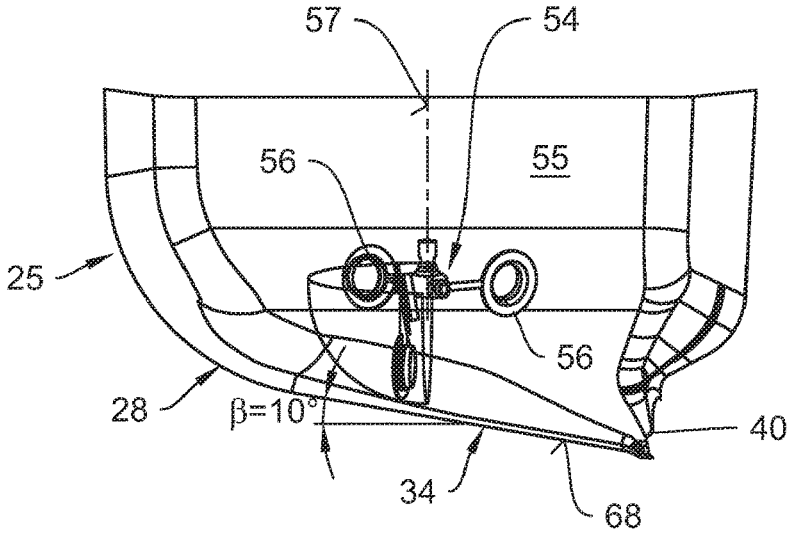
Fig. 8
Fig. 9
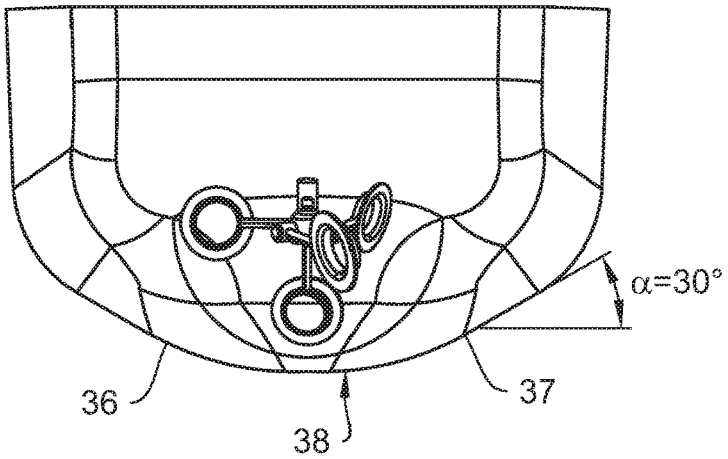
Fig. 10
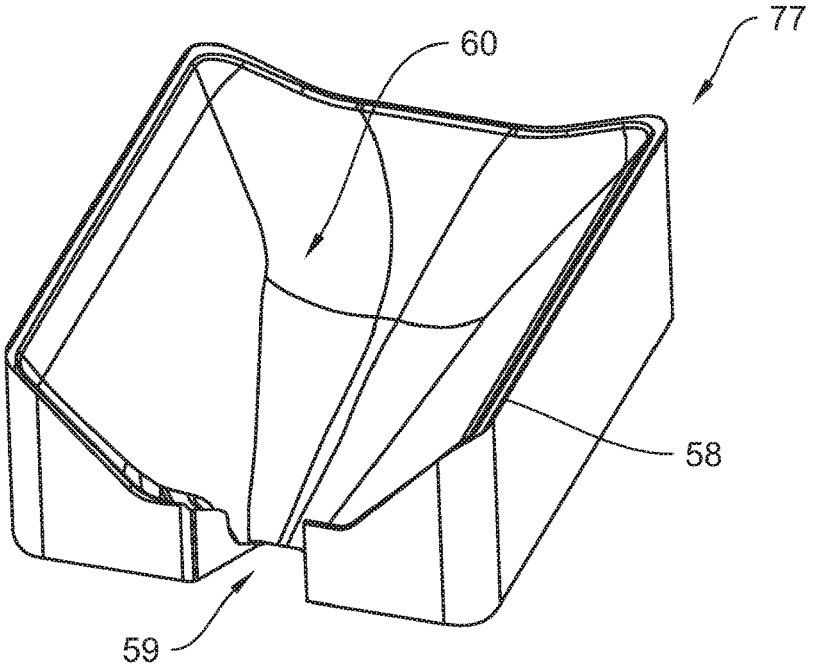

INNER CONTAINER MADE OF PLASTIC AND TRANSPORT AND STORAGE CONTAINER FOR LIQUIDS COMPRISING SUCH AN INNER CONTAINER

CROSS REFERENCE TO RELATED APPLICATIONS

This application is a United States National Phase Application of International Application PCT/EP2014/064235 filed Jul. 3, 2014 and claims the benefit of priority under 35 U.S.C. § 119 of German Patent Application 10 2013 213 167.4 filed Jul. 4, 2013, the entire contents of which are incorporated herein by reference.

FIELD OF THE INVENTION

The invention relates to an inner container made of plastic for transporting and storing liquids, said inner container comprising a filling neck in an upper bottom wall for filling the inner container and an outlet neck on a front side for connecting an outlet armature and a lower bottom wall interconnecting two side walls, a rear wall and a front wall of the inner container for supporting the inner container on a pallet base of a transport pallet which is provided with an outer mantle for receiving the inner container. Furthermore, the invention relates to a transport and storage container comprising such an inner container.

BACKGROUND OF THE INVENTION

Inner containers of the afore-mentioned kind are used as an exchangeable component of transport and storage containers, which serve to transport and store liquids and are commonly used as so-called circulating containers, which are filled repeatedly. To achieve a maximum turnover volume of the liquids filled into inner containers, it is substantial to ensure that the container is emptied as completely as possible so that the entire container volume is available for refilling in the next filling process. Furthermore, it is also important to achieve an emptying as complete as possible of the container in the interest of an economic, substantially complete utilization of the content of the container and to avoid costly purging and cleaning processes.

A substantially complete draining of the known inner containers may prove very elaborate and time-consuming in particular in connection with highly viscous filling products which exhibit good wetting properties with regard to the inner walls of the inner container because the shape of the container is substantially aimed at providing a container with a maximized container volume which is additionally adapted in terms of its exterior dimensions and its design to the receiving space defined on the transport pallet within the outer mantle.

With respect to emptying the inner container as completely as possible, particular problems arise in the storage of thixotropic liquids such as lacquers whose viscosity must usually be reduced by stirring in order to allow a subsequent removal of the lacquers from the container and subsequent processing of the lacquers by spraying surfaces to be lacquered, for example. After an incomplete emptying of the container, the viscosity of the resting liquid increases again so that the amount of lacquer remaining in the inner container has to be stirred up again before performing another lacquering process.

Stirring up a residual or partial amount which remains in the inner container as a result of a successive removal of partial amounts, for example, is necessary in practice not only with lacquers but basically with all liquids that may exhibit separation due to storage. Separated dispersions, for example, can be homogenized by stirring. A residual amount that cannot be stirred up, such as a separated lacquer, is useless and may have to be disposed of in a costly manner.

For stirring, stirrer devices are usually introduced into the inner container through the filling opening formed in the upper bottom wall of the inner container, by means of which the residual amount remaining in the inner container can be stirred up. To completely use up the lacquer remaining in the inner container, it is necessary that the residual amount can be stirred up as completely as possible, i.e. that the stirrable residual amount is minimized so as to be able to use up the entire content of the container in the economic interest of the lacquer processor.

SUMMARY OF THE INVENTION

Therefore, it is an object of the present invention to propose an inner container made of plastic for transporting and storing liquids as well as a transport and storage container comprising such an inner container which allows the container to be emptied to the largest possible extent even in case of thixotropic liquids.

According to the invention, the outlet neck of the inner container is arranged at a hopper bottom of an outlet hopper formed in the lower bottom wall, the outlet hopper having a front hopper wall, which comprises the outlet neck, and two lateral hopper walls which are inclined to each other in a V-shape, are arranged at a hopper angle $\alpha$ in relation to the horizontal and extend starting from a keel-shaped hopper base to a lower edge of a side wall, a keel line of the keel-shaped hopper base rising at a hopper angle $\beta$ in relation to the horizontal from the outlet neck arranged below the front wall toward the rear wall.

The design according to the invention utilizes the lower bottom wall for forming an outlet hopper which allows even highly viscous liquids to drain off in the area of the lower bottom wall toward the hopper base because of the lateral hopper walls which are inclined to each other in a V-shape in connection with the hopper base which is keel-shaped and extends from the outlet neck toward the rear wall with a rising keel line so that it is ensured that the residual amount remaining in the inner container accumulates at the hopper base. Moreover, the keel-shaped hopper base forms a drain channel which extends from the outlet neck toward the rear wall.

The formation of such an accumulation which forms a bath of the residual amount is a prerequisite for being able to use a stirrer on the residual amount at all, i.e. for the stirrer to be able to become submerged in the bath of the residual amount, and for preventing the formation of liquid clusters outside of the area accessible to the stirrer to the largest possible extent.

In a preferred embodiment of the inner container, the keel-shaped hopper base is formed in the shape of a bowl with a concave cross-section and rising in a wedge-shaped fashion starting from the hopper bottom toward the rear wall. In this way, it becomes possible to form the lower bottom wall in such a manner that the gradient of the lateral walls inclined to each other in a V-shape continues in the area of the hopper base and because of its concave and wedge-shaped design, the hopper base forms a substantial portion of a reservoir that is formed in the lower bottom wall and that allows the stirrer to become submerged.

If the hopper angle α is between 25° and 50° in a cross-section of the inner container running through the filling opening, it is ensured on the one hand that a sufficient gradient of the hopper walls toward the keel-shaped hopper base is formed and on the other hand that a stirring mechanism can also be introduced into the hopper base as deeply as possible and with smallest possible distance to the side walls.

If, in addition, the hopper angle β is between 5° and 15°, a particularly advantageously optimized design of the lower bottom wall of the inner container becomes possible, which, with a container volume as large as possible, allows the formation of a particularly effectively designed reservoir in the lower bottom wall.

Preferably, the keel-shaped hopper base has, in the direction of the rear wall, an end portion with a transitional wall portion which extends horizontally toward the rear wall and which has a horizontal contour in a cross-section of the inner container and ends with a curved contour in the rear wall in a longitudinal section of the inner container so that the formation of liquid clusters, i.e. of surface areas on which liquid can accumulate in an undesired manner, is prevented in the critical transition area from the keel-shaped hopper base toward the usually evenly formed and vertically oriented rear wall of the inner container.

A particularly smooth transition with a surface free of bumps or indentations becomes possible if the curved contour has a constant radius and preferably ends in the rear wall without a gradient.

Preferably, the front hopper wall is inclined from a lower edge of the front wall toward the hopper bottom so that a recessed arrangement of the outlet neck with respect to the front wall of the inner container and a correspondingly recessed and thus protected arrangement of an outlet armature mounted on the outlet neck is possible. Furthermore, the inclined front hopper wall permits adapting the gradient angle of the front hopper wall to the gradient angles of the lateral hopper walls.

For a proper function of the outlet hopper, however, it is sufficient if, according to a possible embodiment, the front hopper wall is formed by a triangular extension of the front wall, said extension preferably extending in the plane of the front wall.

A particularly low flow resistance facilitating the emptying of the inner container is achieved in the inlet area of the outlet neck if the hopper bottom is formed in the shape of a cup and has a connecting surface for the outlet neck, said connecting surface being formed on a lower edge of the front hopper wall and being arranged parallel to the front wall of the inner container.

If, according to a particularly preferred embodiment, the inner container is provided with a stirring mechanism whose stirrer head reaches into a stirring space formed in the bottom wall, even smallest residual amounts can be accumulated in the stirring space and be stirred up by the stirring mechanism, which is combined with the inner container and whose stirrer head is suitably designed so as to be able to reach into said stirring space.

If the keel-shaped hopper base forms a groove-shaped drain channel extending from the outlet neck toward the rear wall, it is ensured that the residual amount remaining in the inner container accumulates at the hopper base. This is the case to a particular extent if the groove-shaped drain channel formed by the keel-shaped hopper base widens from the outlet neck toward the rear wall.

The transport and storage container for liquids according to the invention comprises an inner container made of plastic having the features discussed above, wherein the inner container is arranged with its lower bottom wall for support on a pallet base of a transport pallet provided with an outer mantle for receiving the inner container and a support means is arranged between the lower bottom wall of the inner container and the pallet base, said support means having a support surface that is adapted to the bottom wall.

The transport and storage container according to the invention thus allows using an inner container which has the advantages previously explained in detail above by simply combining a conventional transport pallet having an outer mantle with a support means.

The transport and storage container according to the invention permits using an inner container which allows improved emptying without needing to deviate from the transport pallet commonly used with a transport and storage container or from the commonly formed outer mantle in order to be able to utilize the advantageous effects of the inner container.

The combination of the lower bottom wall designed in a special manner as an outlet hopper with the support means adapted thereto allows forming a mechanical engagement connection between the inner container and the support means, said connection relieving the outer mantle from dynamic shear forces as they occur during transport, for example, so that the transport and storage container exhibits increased transport safety.

Particularly advantageous effects with regard to the total height of the transport and storage container and thus also for the tipping stability or stacking safety occur if, for forming the support surface for the bottom wall, the support means has a support frame with a recess for the outlet hopper and with a recess for passage of an outlet armature arranged on the outlet neck so that the outlet neck can be received in the support means in a recessed manner.

Preferably, the support frame has a support brace for supporting the inner container, said support brace bridging the recess for passage of the outlet armature arranged o the outlet neck.

If, according to an advantageous embodiment, the support means for forming the support surface for the lower bottom wall has a support depression, a particularly safe support of the inner container with optimal force transmission of the surface load acting from the inner container onto the transport pallet is realized.

To reduce the number of components of a transport and storage container, the support means can be formed contiguously in one piece with the pallet base, i.e. it can be produced as a molded part, for example.

It is particularly advantageous if the support means is formed as a blow-molded part so that the same technology can be used for producing the support means as for producing the inner container.

Alternatively, it is possible to form the support means as an injection-molded part so that, by way of an optimized design, the support means can be implemented with a minimum of material used and yet in a dynamically highly resilient fashion.

It is advantageous in particular for producing a support means that is composed of simple plane parts and yet permits adaption to the surface of the pallet base and to the lower bottom wall as well as to the outlet hopper of the inner container if the support means is formed as a bearing structure with a plurality of bearing ribs which are arranged transversely to the longitudinal direction of the inner container and are interconnected by horizontal connecting elements.

If the support means is formed as a bar structure with a plurality of interconnected bars, it is possible, for example, to implement the support means as a welded structure, in particular the use of pipes proving advantageous because of their high rigidity in proportion to the material used. If the bar structure is formed at least in part by bars of the outer mantle, the material used for production of the bar structure can be minimized by using already present bars of the outer mantle.

To avoid undesired surface pressure on the contact points between the bars of the bar structure and the inner container, it is advantageous if the bar structure for forming support surfaces is provided with bearing surfaces, which are preferably formed from sheet metal cuttings, so that welding them to the bars of the bar structure is easily possible.

In the following, a preferred embodiment of the inner container according to the invention and of the transport and storage container according to the invention will be explained in more detail with the aid of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a perspective view showing a transport and storage container with an inner container arranged on a support means;

FIG. 2 is a perspective view showing the support means arranged on a transport pallet of the transport and storage container illustrated in FIG. 1;

FIG. 6 is an isometric illustration of the inner container, laterally from the rear;

FIG. 7 is an isometric illustration of the inner container illustrated in FIG. 3, laterally from below;

FIG. 8 is a longitudinal-sectional illustration of the lower portion of the inner container illustrated in FIG. 3 according to section line VIII-VIII in FIG. 3 with a stirrer head arranged in the container interior;

FIG. 9 is a perspective view showing a cross-section illustration of the lower portion of the inner container illustrated in FIG. 3 with the stirrer head arranged in the container interior;

FIG. 10 is an isometric illustration showing a support means;

DESCRIPTION OF THE PREFERRED EMBODIMENTS

Figure 3:
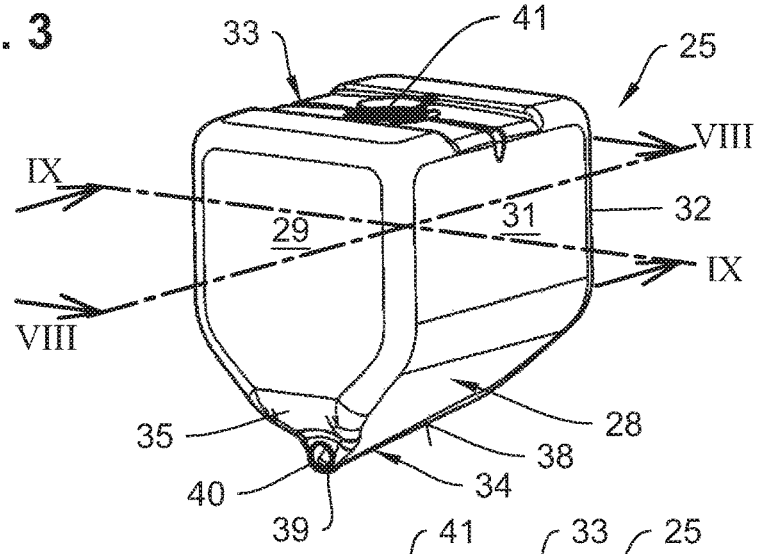
FIG. 3 is a view showing the inner container illustrated in FIG. 1 in an isometric illustration, laterally from the front.

FIG. 1 shows a transport and storage container 20 which receives an inner container 25 made of plastic on a transport pallet 21 in an outer mantle 24 formed here as a cage mantle with vertical bars 22 and horizontal bars 23. A support means 27 is arranged between the inner container 25 and a pallet base 26 of the transport pallet 21, the inner container 25 being supported on said support means 27 with a lower bottom wall 28 of the inner container 25 illustrated in FIG. 3.

Figure 4:
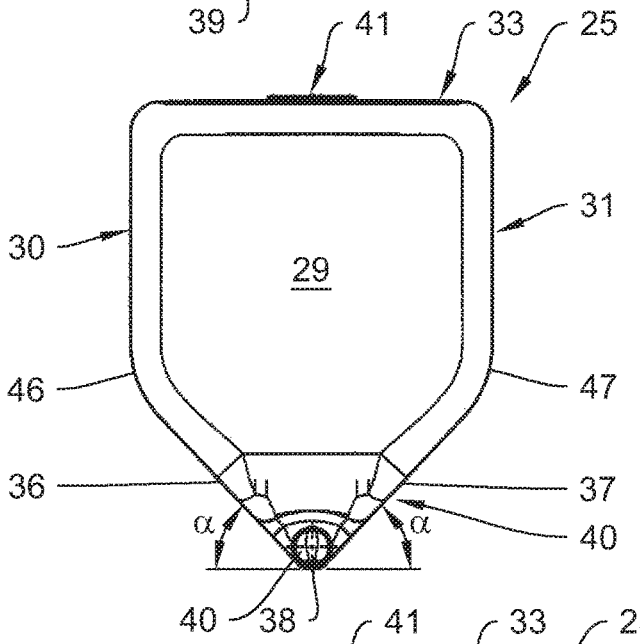
FIG. 4 is a front view of the inner container illustrated in FIG. 3.
Figure 5:
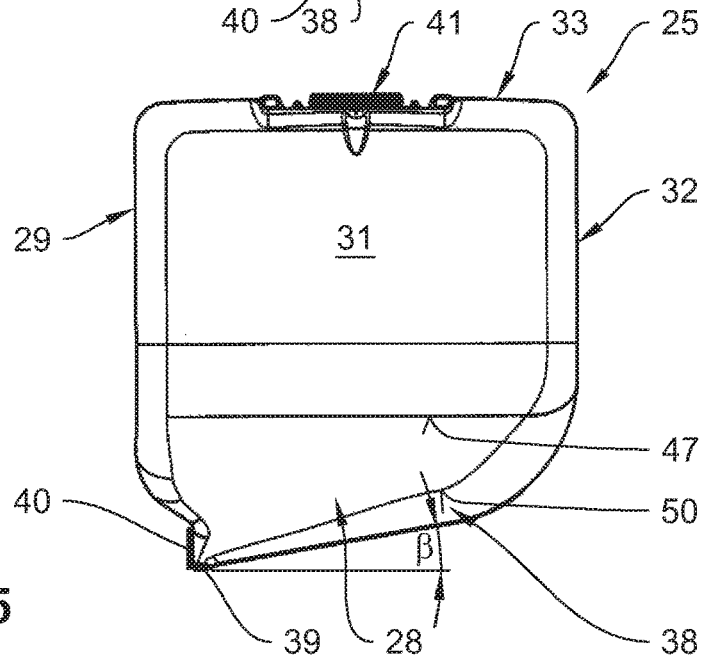
FIG. 5 is a lateral view of the inner container illustrated in FIG. 3.

As shown in FIGS. 3 to 5, adjacent to the lower bottom wall 28, the inner container 25 has a front wall 29, two opposing side walls 30, 31, a rear wall 32 and an upper bottom wall 33 opposite of the lower bottom wall 28.

In the lower bottom wall 28, an outlet hopper 34 is formed, including a front hopper wall 35 and two lateral hopper walls 36, 37 which are inclined to each other in a V-shape and which are connected to each other in a keel-shaped hopper base 38. The inner container 25 has an outlet neck 40 on a front hopper wall 35 connected to a lower edge of the front wall 29 adjacent to a hopper bottom 39, which forms the area of the outlet hopper 34 lying deepest, said outlet neck 40 serving to connect an outlet armature (not illustrated) which allows tapping a filling material from the inner container 25 which has been previously filled into the inner container 25 through a filling opening 41 in the upper bottom wall 33.

The transport pallet 21 of the transport and storage container 20 illustrated in FIG. 1 is implemented as a skid-type pallet with a center skid 42 and two outer skids 43, 44, on which support legs 45 are arranged that support the pallet base 26 on which the support means 27 and the outer mantle 24 are arranged.

Departing from the transport pallet 21 embodied as a skid-type pallet illustrated in FIG. 1, the transport pallet can also be embodied as a frame pallet with a circumferentially closed base frame instead of the center skid 42 and the two outer skids 43, 44. Departing from the embodiment illustrated in FIG. 1, in which the pallet base 26 is formed as a shaped sheet metal part and the support means 27 consists of a blow-molded part made of plastic, for example, the pallet base can also be a plastic component, wherein in particular an contiguous one-piece formation of the support means and of the pallet base from plastic or sheet metal material or another suitable material that allows a formation of the pallet base in one piece with a support means integrally formed thereto is possible as well.

As can be taken in particular from a combined view of FIGS. 4 and 5, the lateral hopper walls 36, 37 are arranged at a hopper angle $\alpha$ in relation to the horizontal and each extend from a lower edge 46, 47 of the lateral walls 30, 31 to the keel-shaped hopper base 38. The hopper base 38 has a concave cross-section 48 indicated in FIG. 7 and has a wedge-shaped form starting from the hopper bottom 39 toward the rear wall 32 of the inner container 25, so that the lateral hopper walls 36, 37, which are adjacent to the hopper base 38, become narrower in the direction of the rear wall 32, i.e. the preferably horizontally extending lower edges 46, 47 of the side walls 30, 31 and the lower edges 49, 50 of the lateral hopper walls 36, 37 come closer to each other in the direction of the rear wall 32 of the inner container 25.

In the inner container 25 illustrated in FIGS. 3 to 7, the outlet hopper 34 is formed such that the lateral hopper walls 36, 37 (FIG. 4) have a hopper angle $\alpha=30°$ and a hopper angle $\beta=10°$ formed between a keel line 63 (FIG. 5) of the keel-shaped hopper base 38 and the horizontal.

Irrespective of the illustrated embodiment examples, it is a general fact that the hopper walls as well as the keel line are preferably formed in a substantially even or straight manner, yet may also have a slight curvature of the surface or of the line at least in areas. In this case, the angles α and β refer to the tangents drawn to the surfaces and to the keel line.

As can further be taken in particular from FIGS. 6 and 7, the keel-shaped hopper base 38 has an end portion 52 in the direction of the rear wall, including a transitional wall portion 53 which extends horizontally toward the rear wall 32 and transversely to a longitudinal axis 64 and which is substantially formed as a triangular cylinder shell segment and here has a horizontal contour 65 in a cross-section of the inner container 25 and ends with a curved contour 66 in the rear wall 32 in a longitudinal section of the inner container 25.

In FIGS. 8 and 9, for illustrating the advantageous design of the lower bottom wall 28 of the inner container 25, a stirrer head 54 of a stirring mechanism introduced into a container interior 55 through the filling opening 41 (FIG. 3) is shown. In the configuration of the stirrer head 54 illustrated in FIGS. 8 and 9, stirrer blades 56, which are swung against a stirrer axis 57 in order to be introduced through the filling opening 41, are illustrated in their swung-out operating configuration. When the stirrer head 54 rotates, the stirrer blades 56 operate in a stirring space 67 indicated by the hatching in FIGS. 8 and 9.

To make possible a minimized stirrable residual amount of a liquid accumulated in the area of the outlet hopper 34, it is substantial that a maximum portion of the lumen of the outlet hopper adjacent to the outlet neck 40 and with minimal distance to the wall of the outlet hopper 34 is covered by the stirring space 67. On the other hand, the design of the outlet hopper 34 in the lower bottom wall 28 should restrict the holding capacity of the inner container 25 as little as possible, both these afore-mentioned requirements having to be considered in an optimal design of an outlet hopper 34 formed in the lower bottom wall 28.

The partial-section illustrations of the inner container 25 shown in FIGS. 8 and 9 make clear that the above is achieved in the illustrated embodiment example in that a hopper angle α of 30° is formed between the lateral hopper walls 36, 37 and the horizontal and a hopper angle β between the keel line 63 of the concave hopper base 38 and the horizontal is 10°.

FIG. 10 shows the support means 27, which in the present case is formed as a one-piece blow-molded part and has a support frame 58 with a recess 59 for receiving an outlet armature arranged on the outlet neck 40 of the inner container 25 illustrated in FIG. 3, for example. The support means 27 has a support depression 60 whose surface forms a support surface 61. As can be taken from FIG. 10, the support surface 61 is designed such that partial surfaces are formed whose relative arrangement and contour correspond to the lateral hopper walls 36, 37 and to the hopper base 38 as well as to the transitional part 53 in the end portion of the hopper base 38 of the inner container 25.

Figure 11:
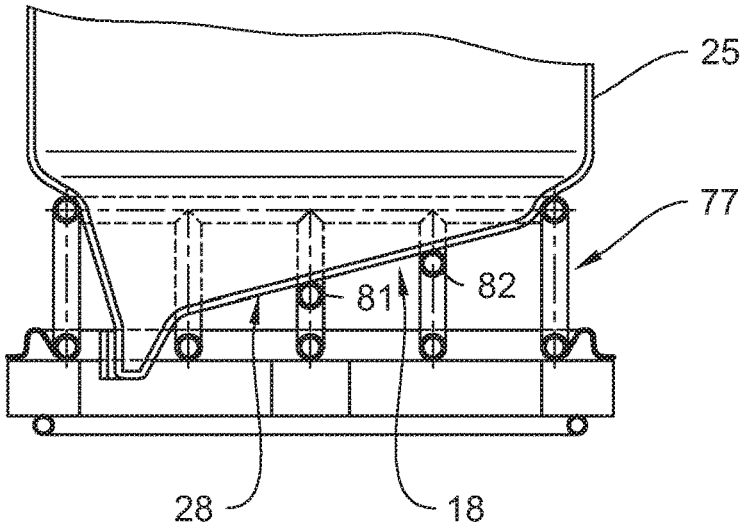
FIG. 11 is a sectional illustration showing another embodiment of a support means.
Figure 12:
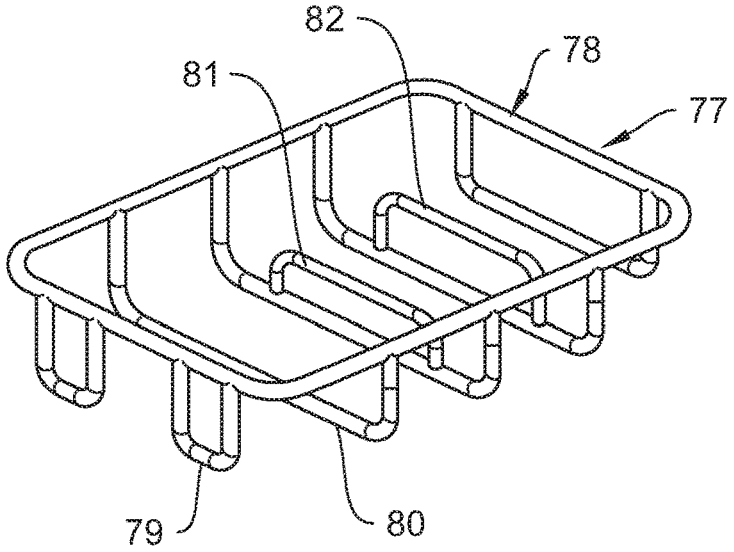
FIG. 12 is an isometric illustration showing the support means illustrated in FIG. 11.
Figure 13:
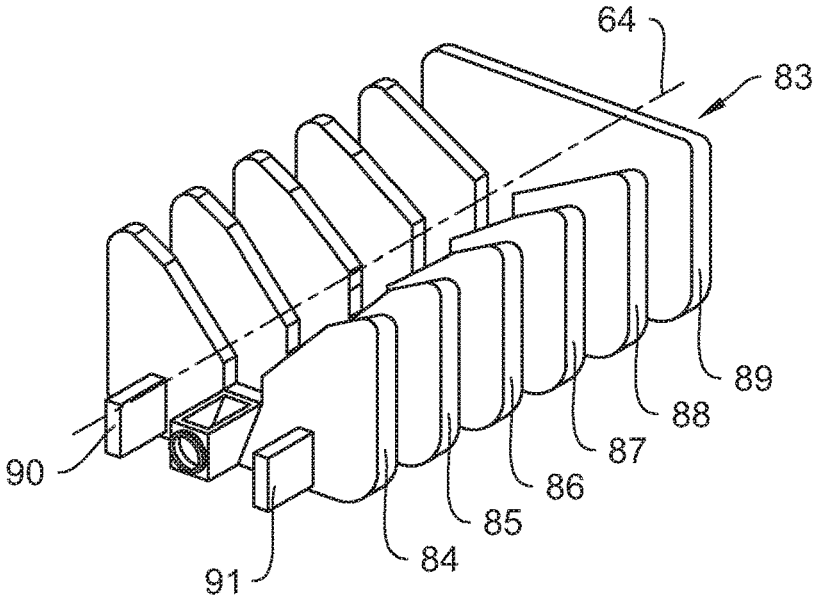
FIG. 13 is an isometric illustration showing another embodiment of a support means.

Departing from the support means 27 illustrated in FIG. 10, which can be produced as a blow-molded part or injection-molded part, FIGS. 11 to 13 show examples of other possible designs.

For example, FIGS. 11 and 12 show a support means 77 that is formed as a bar structure with a closed frame 78 and with bars 79, 80 that are bent in a U-shape and connected to the frame 78 and which consist of differently shaped pipe pieces.

As is shown in particular in FIG. 11, support bars 81, 82 are provided on the bars 80, which form bar bridges for supporting the lower bottom wall 28 of the inner container 25 and are designed to have different heights corresponding to the surface contour of the lower bottom wall 28.

FIG. 13 shows, as another possible embodiment, a support device 83 that is formed as a bearing structure with a plurality of bearing ribs 84 to 89 which are arranged transversely to the longitudinal axis 64 of the inner container 25 and are interconnected and secured in their relative arrangement by horizontal connecting elements 90, 91. The respective height or shape of the bearing ribs 84 to 89 is selected such that an adaptation to the lower bottom wall 28 of the inner container 25 is possible (FIG. 11).

While specific embodiments of the invention have been shown and described in detail to illustrate the application of the principles of the invention, it will be understood that the invention may be embodied otherwise without departing from such principles.

The invention claimed is:

1. An inner container made of plastic for transporting and storing liquids, said container comprising:

an upper wall with a filling neck for filling the inner container;

a front wall;

a rear wall;

two side walls;

a lower bottom wall interconnecting the two side walls, the rear wall and the front wall for supporting the inner container on a pallet base of a transport pallet which is provided with an outer mantle for receiving the inner container;

an outlet hopper;

an outlet neck for connecting an outlet armature at a front side of the inner container, the outlet neck being arranged at a hopper bottom of the outlet hopper, the outlet hopper being formed in the lower bottom wall, the outlet hopper having a front hopper wall comprising the outlet neck and two lateral hopper walls which are inclined relative to each other in a V-shape, are arranged at a first hopper angle in relation to horizontal and each of the lateral hopper walls extend from a keel-shaped hopper base to a lower edge of an associated one of the side walls, a keel line of the keel-shaped hopper base rising at a second hopper angle in relation to the horizontal from the outlet neck, arranged below the front wall, toward the rear wall, wherein the keel-shaped hopper base is formed in the shape of a bowl having a concave cross-section and rising in the shape of a wedge starting from the hopper bottom toward the rear wall, the keel-shaped hopper base forming a groove-shaped drain channel comprising a widening groove-shaped drain channel directly extending from the outlet neck toward the rear wall, wherein the widening groove-shaped drain channel continuously widens along a longitudinal axis of the inner container from the outlet neck until reaching the rear wall.

2. The inner container according to claim 1, wherein the first hopper angle is between 25° and 50°, the groove-shaped drain channel being in fluid communication with an interior space of the keel-shaped hopper base.

3. The inner container according to claim 1, wherein the second hopper angle is between 5° and 15°.

4. The inner container according to claim 1, wherein the front hopper wall is inclined from a lower edge of the front wall toward the hopper bottom, at least the upper wall, the front wall, the rear wall, the two side walls, the outlet hopper and the lower bottom wall defining an inner container structure, the inner container structure comprising a keel-shaped lower part, the keel-shaped hopper base defining at least a portion of the keel-shaped lower part, the groove-shaped drain channel being in fluid communication with an interior space of the inner container structure.

5. The inner container according to claim 1, wherein the front hopper wall is formed by a triangular extension of the front wall which extends in the plane of the front wall.

6. The inner container according to claim 1, wherein the hopper bottom is cup-shaped and has a connecting surface for the outlet neck, said connecting surface being formed on the front hopper wall and being parallel to the front wall of the inner container.

7. The inner container according to claim 1, further comprising a stirring mechanism with a stirrer head that reaches into a stirring space formed in the bottom wall.

8. An inner container made of plastic for transporting and storing liquids, the container comprising:

an upper wall with a filling neck for filling the inner container;

a front wall;

a rear wall;

two side walls;

a lower bottom wall interconnecting the two side walls, the rear wall and the front wall for supporting the inner container on a pallet base of a transport pallet which is provided with an outer mantle for receiving the inner container;

an outlet hopper;

an outlet neck for connecting an outlet armature at a front side of the inner container, the outlet neck being arranged at a hopper bottom of the outlet hopper, the outlet hopper being formed in the lower bottom wall, the outlet hopper having a front hopper wall comprising the outlet neck and two lateral hopper walls which are inclined relative to each other in a V-shape, are arranged at a first hopper angle in relation to horizontal and each of the lateral hopper walls extend from a keel-shaped hopper base to a lower edge of an associated one of the side walls, a keel line of the keel-shaped hopper base rising at a second hopper angle in relation to the horizontal from the outlet neck, arranged below the front wall, toward the rear wall, wherein the keel-shaped hopper base is formed in the shape of a bowl having a concave cross-section and rising in the shape of a wedge starting from the hopper bottom toward the rear wall, the keel-shaped hopper base forming a groove-shaped drain channel comprising a widening groove-shaped drain channel directly extending from the outlet neck toward the rear wall, wherein the widening groove-shaped drain channel continuously widens from the outlet neck toward the rear wall, wherein the keel-shaped hopper base has an end portion in the direction of the rear wall, comprising a transitional wall portion that extends horizontally toward the rear wall and has a horizontal contour in a cross-section of the inner container and ends with a curved contour in the rear wall in a longitudinal section of the inner container.

9. The inner container according to claim 8, wherein the curved contour has a constant radius, at least the upper wall, the front wall, the rear wall, the two side walls, the outlet hopper and the lower bottom wall defining an inner container structure, the inner container structure comprising a keel-shaped lower part, the keel-shaped hopper base defining at least a portion of the keel-shaped lower part, the groove-shaped drain channel being in fluid communication with an interior of the inner container structure.

10. A transport and storage container for liquids comprising:

an inner container made of plastic, the inner container comprising:

an upper wall with a filling neck for filling the inner container;

a front wall;

a rear wall;

two side walls;

a lower bottom wall interconnecting the two side walls, the rear wall and the front wall;

an outlet hopper;

an outlet neck for connecting an outlet armature at a front side of the inner container, the outlet neck being arranged at a hopper bottom of the outlet hopper, the outlet hopper being formed in the lower bottom wall, the outlet hopper having a front hopper wall comprising the outlet neck and two lateral hopper walls which are inclined relative to each other in a V-shape, are arranged at a first hopper angle in relation to horizontal and each of the lateral hopper walls extend from a keel-shaped hopper base to a lower edge of an associated one of the side walls, a keel line of the keel-shaped hopper base rising at a second hopper angle in relation to the horizontal from the outlet neck, arranged below the front wall, toward the rear wall, wherein the keel-shaped hopper base is formed in the shape of a bowl having a concave cross-section and rising in the shape of a wedge starting from the hopper bottom toward the rear wall, the keel-shaped hopper base forming a groove-shaped drain channel comprising a widening groove-shaped drain channel, which extends directly from the outlet neck toward the rear wall, wherein a width of the widening groove-shaped drain channel continuously increases along a longitudinal axis of the inner container directly from the outlet neck toward the rear wall; and a transport pallet, wherein, for support, the inner container is arranged with the lower bottom wall on a pallet base of the transport pallet provided with an outer mantle for receiving the inner container and a support means is arranged between the lower bottom wall of the inner container and the pallet base, said support means having a support surface that is adapted to the bottom wall.

11. The transport and storage container according to claim 10, wherein for forming the support surface for the lower bottom wall, the support means has a support frame comprising a recess for receiving the outlet hopper and with another recess for passage of an outlet armature arranged on the outlet neck, the inner container comprising a keel-shaped lower part, at least the keel-shaped hopper base defining the keel-shaped lower part, the groove-shaped drain channel being in fluid communication with an interior space of the inner container.

12. The transport and storage container according to claim 11, wherein for supporting the inner container, the support frame has a support brace which bridges the another recess for passage of the outlet armature arranged on the outlet neck.

13. The transport and storage container according to claim 11, wherein the support means has a support depression for forming the support surface for the lower bottom wall.

14. The transport and storage container according to claim 10, wherein the support means is formed contiguously in one piece with the pallet base.

15. The transport and storage container according to claim 10, wherein the support means is formed as a blow-molded part.

16. The transport and storage container according to claim 10, wherein the support means is formed as an injection-molded part.

17. The transport and storage container according to claim 10, wherein the support means is formed as a bearing structure with a plurality of bearing ribs which are arranged transversely to the longitudinal axis of the inner container and are inter-connected via horizontal connecting elements.

18. The transport and storage container according to claim 10, wherein the support means is formed as a bar structure comprising a plurality of interconnected bars.

19. The transport and storage container according to claim 18, wherein the bars are formed as pipes.

20. The transport and storage container according to claim 18, wherein the bar structure is formed at least in part by the bars of the outer mantle.

21. The transport and storage container according to claim 18, wherein the bar structure is provided with bearing surfaces for forming support surfaces.

22. The transport and storage container according to claim 21, wherein the bearing surfaces are formed from at least one sheet metal cutting.

23. An inner container made of plastic for transporting and storing liquids, said container comprising:

an upper wall with a filling neck for filling the inner container;

a front wall;

a rear wall;

two side walls;

a lower bottom wall interconnecting the two side walls, the rear wall and the front wall for supporting the inner container on a pallet base of a transport pallet which is provided with an outer mantle for receiving the inner container;

an outlet hopper;

an outlet neck for connecting an outlet armature at a front side of the inner container, the outlet neck being arranged at a hopper bottom of the outlet hopper, the outlet hopper being formed in the lower bottom wall, the outlet hopper having a front hopper wall comprising the outlet neck and two lateral hopper walls which are inclined relative to each other in a V-shape, are arranged at a first hopper angle in relation to horizontal and each of the lateral hopper walls extend from a keel-shaped hopper base to a lower edge of an associated one of the side walls, a keel line of the keel-shaped hopper base rising at a second hopper angle in relation to the horizontal from the outlet neck, arranged below the front wall, toward the rear wall, the keel-shaped hopper base comprising a base portion extending from the outlet neck toward the rear wall, wherein a distance between the base portion and horizontal increases in a direction of the rear wall, the base portion comprising a linear base portion and an arcuate base portion, the linear base portion being connected to the rear wall via the arcuate base portion, at least a portion of the arcuate base portion being located adjacent to the rear wall, wherein the linear base portion extends continuously from a position adjacent to the outlet neck to a position adjacent to the arcuate base portion, the keel-shaped hopper base comprising a concave inner surface defining a groove-shaped drain channel extending directly from the outlet neck to the rear wall, wherein a width of the groove-shaped drain channel along a longitudinal axis of the inner container continuously increases from the outlet neck to the rear wall.

24. The inner container according to claim 23, wherein the keel-shaped hopper base is formed in the shape of a bowl having a concave cross-section and rising in a shape of a wedge starting from the hopper bottom toward the rear wall, wherein a width of the concave cross-section continuously increases from the outlet neck to the rear wall; at least a portion of the base portion defining the groove-shaped drain channel, wherein a width of the portion of the base portion continuously increases from the outlet neck to the rear wall, wherein an incline of the keel-shaped hopper base continuously increases from a position adjacent to the outlet neck to a position adjacent to the rear wall, the keel-shaped hopper base defining at least a portion of a lower part of the inner container, the groove-shaped drain channel being in fluid communication with an interior space of the inner container.

* * * * *